US005184182A

United States Patent [19]

Michlin

[11] Patent Number: 5,184,182

[45] Date of Patent: Feb. 2, 1993

[54] COPIER AND PRINTER TONER HOPPER SEALING DEVICE

[76] Inventor: Steven B. Michlin, 5310 Bentley Suite 105, West Bloomfield, Mich. 48322

[21] Appl. No.: 845,722

[22] Filed: Mar. 4, 1992

[51] Int. Cl.[5] ..... G03G 15/06; G03G 21/00

[52] U.S. Cl. ..... 355/260; 141/363; 141/364; 222/DIG. 1; 355/200; 355/245

[58] Field of Search ..... 355/260, 245, 200, 202; 222/DIG. 1, 325, 561; 229/125.12; 141/363, 364

[56] References Cited

U.S. PATENT DOCUMENTS

| | | | |
|---|---|---|---|
| 958,707 | 5/1910 | Stafford | 229/125.12 |
| 4,615,608 | 10/1986 | Mizutani | 222/DIG. 1 |
| 4,732,277 | 3/1988 | Smith | 222/DIG. 1 |
| 4,778,086 | 10/1988 | Shibata et al. | 141/364 X |
| 4,816,877 | 3/1989 | Keen | 222/DIG. 1 |
| 4,931,838 | 6/1990 | Ban et al. | 355/260 |
| 4,942,432 | 7/1990 | Mort et al. | 141/363 X |
| 4,961,450 | 10/1990 | Furata | 141/364 |
| 4,981,218 | 1/1991 | Ban et al. | 355/260 X |
| 5,110,646 | 5/1992 | Prestel et al. | 355/260 X |

FOREIGN PATENT DOCUMENTS

| | | | |
|---|---|---|---|
| 0315779 | 12/1989 | Japan | 355/260 |

*Primary Examiner*—A. T. Grimley
*Assistant Examiner*—Matthew S. Smith

[57] ABSTRACT

A toner hopper seal-insert and slide-seal to provide for the shipping and transporting of a re-filled toner cartridge used in printers and copying machines. The seal-insert is comprised of three slotted rectangular strips or pieces of material. A middle piece is sandwiched between two outer pieces. The slot in the middle piece is wider and open at one end, providing a channel for the slide-seal. The seal-insert is attached to the toner hopper of the toner cartridge, and the slide-seal is slid into or out of position in the seal-insert to seal or unseal the opening of the toner hopper, creating a reusable leak-proof seal system. When the constriction in the end of the toner hopper is narrower than the width of the area being sealed, the slide-seal may be made narrow enough and the dimensions of the seal-insert slots may be made such that the slide-seal can be slid through the contriction and still seal the toner hopper opening to prevent the passage of toner.

19 Claims, 3 Drawing Sheets

COPIER AND PRINTER TONER HOPPER SEALING DEVICE

BACKGROUND OF THE INVENTION

This invention relates to an apparatus for providing means for re-sealing a toner hopper, which is a part of an expensive toner cartridge, used on a dry toner printer or copying machine, in order that the hopper, filled with dry toner, can be shipped from one location to another, without spillage of the dry toner powder which behaves similar to a liquid.

It is customary for the manufacturer of a printer or copying machine, using dry toner, to fill the toner hopper with dry toner, and seal the top of the toner hopper with a plastic sheet, attached, and sealed on the sides of the hopper, and on each end of the hopper, just prior to assembling the toner hopper with the other components of a toner cartridge unit. When the toner cartridge is received at the using location, the seal is removed from the toner hopper section of the cartridge, and the printer or copier is ready for use, with the toner exposed to the roller feed device for making copies.

Recent developments in the dry toner imaging industry have led to the use of "throw-away" type toner cartridges, whereby the user of the copier or printer must buy a new, filled, toner cartridge from the manufacturer, when the original toner hopper in the toner cartridge is depleted of toner. This method of throw-away toner cartridges is very expensive to the user of the copier or printer as a new cartridge is required each time the toner in the toner cartridge's toner hopper is depleted. The toner is expensive enough, but to add the expense of a new cartridge, with its toner dispensing means, adds a substantial amount of cost to the replacement procedure.

It has been customary in the past to throw away these very expensive, empty toner cartridges, and replace them with new, filled, and sealed factory toner cartridges. The manufacturers seal the toner hopper components in these new toner cartridges at their manufacturing location, and there is no leakage of the toner during shipment. This type of operation, using expensive throw-away cartridges, has therefore, led to the need for a method and apparatus for re-filling, re-sealing, shipping, and re-using these toner cartridges, with the obvious savings of the cost of the new toner cartridge, in addition to the benefits of avoiding disposal and environmental problems.

No prior art is available for comparison to this invention, although the inventor is aware of several products, which have tried to solve the problem and several references are cited, which tend to outline the problem of dry toner use in these dry toner printers and copiers, and, it is obvious to a prior user of these printers and copiers that any leakage of this dry toner from the toner cartridge unit is a major cleaning problem at best, and may cause severe soiling damage to the surrounding environment, in the normal accident, as well as damage to the equipment.

One such product for re-sealing the dry toner hopper when refilling uses a plastic sheet, which slides into the slot in the toner hopper section of the toner cartridge. created when the original seal is removed.

Another product for re-sealing the dry toner in the re-filled hopper uses a plastic sheet with a magnetic coating, to try to keep the dry toner from spilling during shipment to the user. Still others try to duplicate the factory method which may require disassembly and modification of the toner hopper and thorough cleaning of the seal-grooves.

Most of the prior products, designed for this purpose of sealing the dry toner hopper for shipment, have a major problem in their design. This problem centers around the long slots along the longitudinal sides of the dry toner hopper. These slots are not sealed along this longitudinal axis, after the original seal is removed, and have irregular openings along their longitudinal axis. Now, the prior products, being of a fixed thickness, slide into the uneven slot to fill parts of the distance of the slot, leaving minute openings along the longitudinal axis of the toner hopper, with the resulting leakage of the dry toner during shipment, causing major problems to the shipper and the receiver of the re-filled dry toner hoppers.

Another problem involves some toner hoppers that have a very narrow slot constriction that the toner seal, wider than the slot, must pull through. It is very cumbersome to seal such a toner hopper with a narrow slot constriction because the seal's width must pull through the constriction.

Another problem involves seal re-usability. Of the prior art, those seal systems that are re-usable tend to leak. However, those that do not leak are not re-usable.

Those seal systems that use a form of sticky back tape alone as the seal, have four general problems. First, these seals may tear. Second, they may stick to toner in the slot causing them to unstick therefore, not forming a perfect seal. Prevention of this unsticking requires an excessive amount of extra labor in cleaning toner from the seal-grooves. Third, these seal systems do not consistently seal well. A fourth problem involves foam-tearing. Many such seals that are leakproof tear the sealing foam in the hopper, if not from pulling the seal, whereby the sticky tape tears the foam, then the sealing foam tears from use of the common metallic insertion tool on each usage cycle. Once this foam partially tears out, the hopper will then leak, causing the problem the seal was supposed to prevent.

Another problem with prior art is that those seals that are leakproof tend to take a long time to insert, unlike a slide-seal. Those contemporary seals that are slide-seals, of prior art, tend to leak.

SUMMARY OF THE INVENTION

Accordingly, it is an object of this invention to provide a new and improved apparatus and method for re-sealing re-filled dry toner hoppers, which are usually components of toner cartridges, in a manner to allow for the shipping of these re-filled dry toner cartridges from one location to another, without spillage of the dry toner from the re-filled dry toner hopper, using a permanent slot-insert which acts as a holder for the slide-seal.

Another object of this invention is to provide a re-usable sealing apparatus which is very quick and easy to insert into the slot. A grooved seal-insert is permanently affixed to the toner hopper which then allows a slide-seal to slide in and out of the seal-insert.

In carrying out this invention in the illustrative embodiment thereof, three flat rectangles are made to form the seal-insert. Two are identical rectangles with a centerline slot cut out for the purpose of allowing toner to fall through. These two rectangles sandwich a third identical rectangle in the middle that has a similar slot, however, which is open at one end. These three rectangles are pressed firmly together and sealed together, to form a one-piece seal-insert unit with an open longitudinal centerline slot. This center piece's slot, open on one end, allows the slide-seal to be inserted and removed. This seal-insert is intended for permanent insertion into a toner hopper.

When the slide-seal, consisting of a stiff strip, slides into the center groove of the center rectangle, a perfect seal is achieved so that no toner powder will leak out and the toner hopper may now be shipped from one location to another with little fear of the dry toner leaking from the toner hopper. When the slide-seal is pulled out of its slot, toner may fall through the slot into the top portion of the toner hopper. After toner is completely expended from the toner hopper, when the toner hopper is re-used, the slide-seal may quickly and easily be inserted in the groove of the permanent seal-insert again and again, many times.

The purpose of installing the permanent slotted seal-insert is to modify the hopper so as to to allow a quick to install, reusable slide-seal to seal the unit.

BRIEF DESCRIPTION OF THE DRAWINGS

This invention, together with other objects, features, aspects, and advantages thereof, will be more clearly understood from the following description, considered in conjunction with the accompanying drawings.

COMPLETE DESCRIPTION OF THE PREFERRED EMBODIMENT

Figure 1:
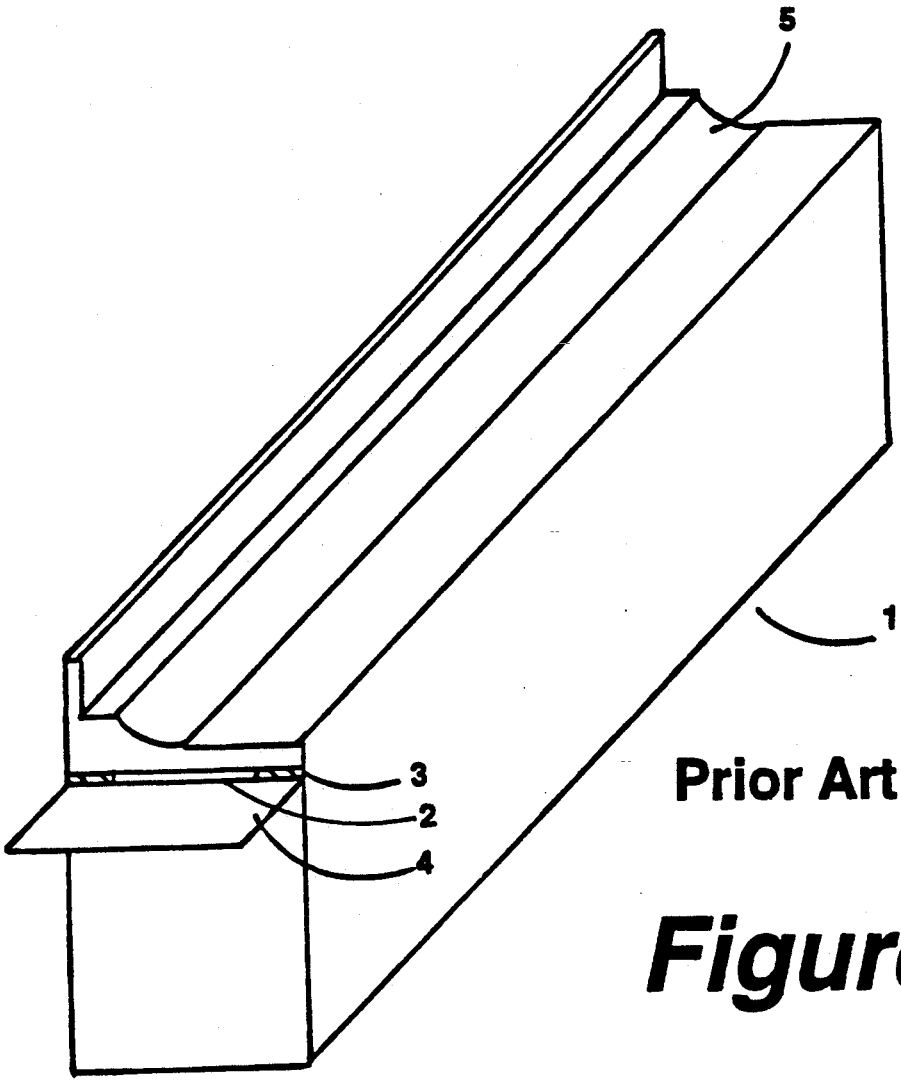
Prior Art Figure 1
FIG. 1 is an isometric view of a typical dry toner hopper, showing the opening where toner falls through in the toner hopper.

Referring now to FIG. 1, a re-usable dry toner hopper, referred to generally by the reference numeral 1, is to be filled with a new supply of dry toner and sealed, thus eliminating the need to discard the expensive toner cartridge that it came from and replace it with a new one. Still referring to FIG. 1, we see a provision for a feed roller, referred to as the numeral 5, and used to dispense the supply of dry toner. Now, it can be seen that if this dry toner hopper was rotated from this upright position, the dry toner would spill from the toner hopper.

Still referring to FIG. 1, we see opening 2, the opening being created when the original factory seal was removed from the toner hopper 1. An attach bracket 4 may provide for holding the original seal tab in place before removal of the original factory seal, for initial operation of the toner cartridge. FIG. 1 also shows a toner hopper sealing material 3, installed at the original factory, not unlike foam, sometimes used in the hopper along the seal perimeter to prevent leakage. It can be seen that means is needed to seal the toner hopper 1 to be re-filled with new dry toner, installed in a toner cartridge, and transported to its destination.

Figure 2:
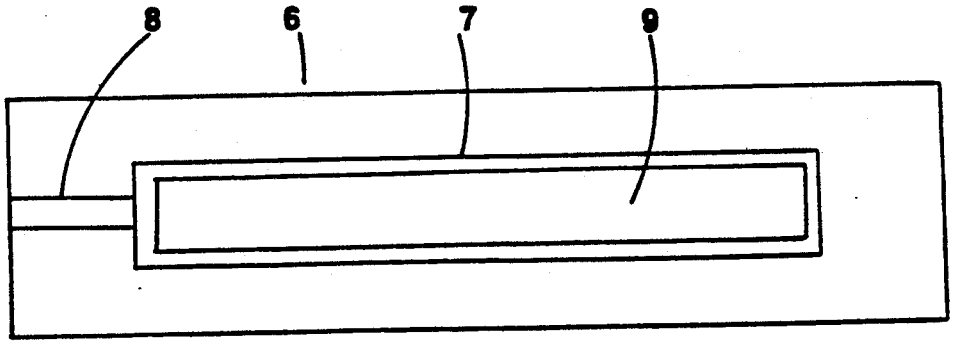
Prior Art Figure 2
FIG. 2 is a top view of another variety of typical toner hopper showing the area toner falls through, the narrow constriction in the toner hopper, and the typical attach-area available to attach the seal-insert.

Now, referring to FIG. 2, another toner hopper 6 is shown of a slightly different style. The original seal-attach-area perimeter 7 is shown so that a seal overlapping this will also cover the opening 9 where dry toner will fall through if the hopper is turned upside down. The width of any pull-seal is limited by the width of the narrow constriction 8 grooved in the toner hopper 6.

It is this constriction 8 in the toner hopper 6 that requires the use of two components to seal the hopper 6. The two components consist of the three-piece seal-insert 10 of FIG. 3, fused or joined together as one component, as shown in an end view in FIG. 5, and the slide-seal 17 shown in FIG. 4. The seal-insert 10 consists of two outer rectangular pieces 11 and 12, sandwiching an inner or middle piece 16. All three pieces are slotted. However, the outer pieces 11 and 12 are slotted with slots 13 whereas the middle piece 16 is slotted with slot 14. The differences in the slots 13 and slot 14 are that slot 14 has an end-opening 15 for insertion of the slide-seal 17, and slots 13 are shorter and narrower than slot 14. This is so that slide-seal 17, when inserted in the open end 15 of slot 14 and slid into position, will more than overlap both slots 13, creating a perfect seal.

Figure 3:
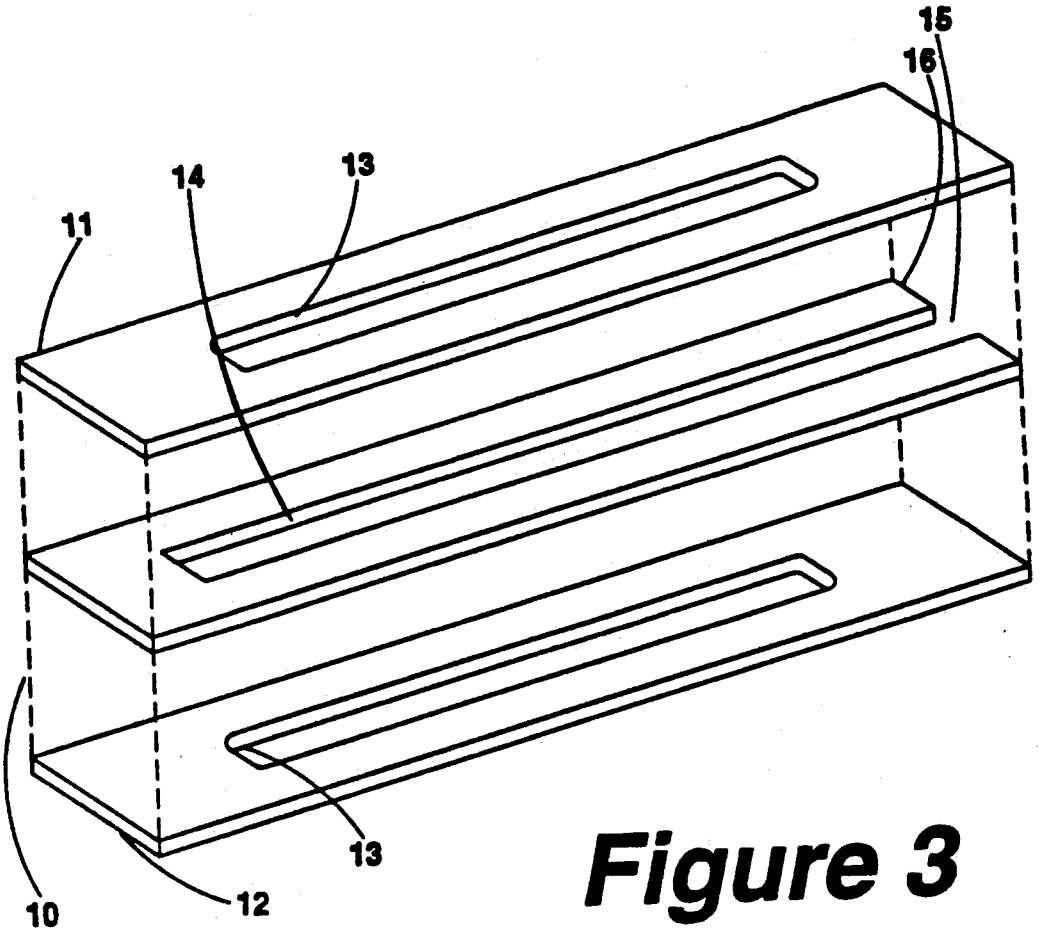
FIG. 3 is an isometric drawing showing the three pieces of the seal-insert unit of this invention.
Figure 4:
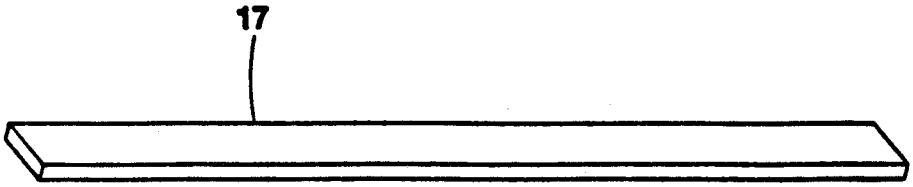
FIG. 4 shows the slide-seal strip that fits into the slot of the seal-insert unit of FIG. 3.
Figure 5:
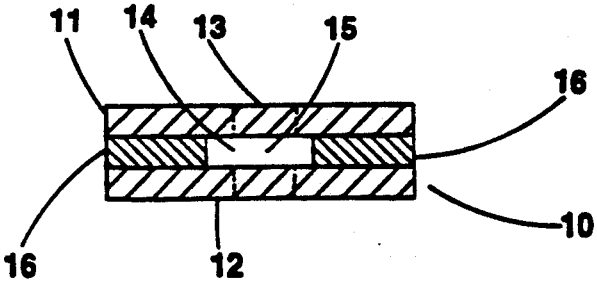
FIG. 5 shows the end view of the seal-insert unit with its slot opening.
Figure 6:
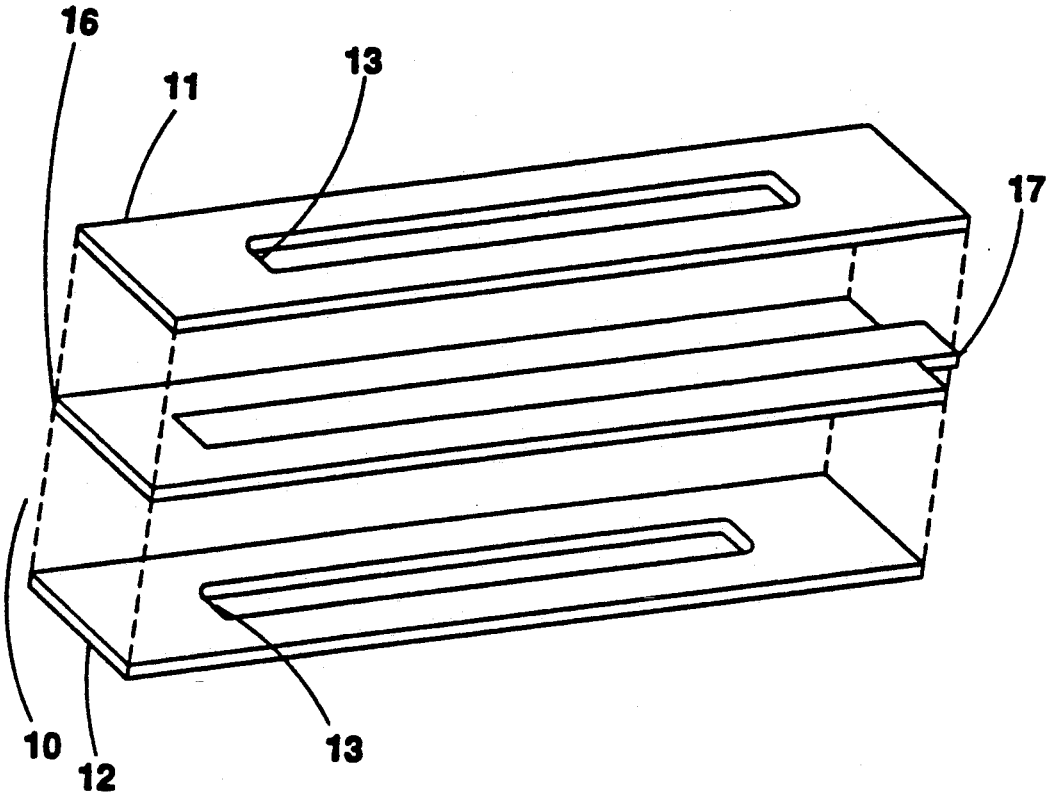
FIG. 6 shows the seal-insert with its three components depicting how the slide-seal strip fits into the slot.

FIG. 6 shows the slide-seal 17 after insertion into the seal-insert 10. This figure is for ease of viewing only. The three pieces of the seal-insert would already be fused into one component 10, as shown in FIG. 5. The pieces could be fused together by a dissolving chemical such as methylene chloride. They could also be joined together by two-sided tape or glue. FIGS. 3 and 6 are only meant to show in a readable way the construction of the seal-insert 10 by breaking it down into its three pieces with dashed lines depicting where they connect. Note that although the outer rectangular pieces 11 and 12 are shown to be identical in FIG. 3, material thicknesses and other dimensions may vary from piece 11 to piece 12 to fit the environment of a particular toner hopper. The middle piece 16 may also be of differing dimension, and the slots of the three pieces, though shown to be longitudinal and located along the centerlines of the pieces in the drawings, may not be along the centerlines of the pieces depending on the situation. There could also be more than three slotted pieces, as long as one or more pieces contain open-ended slots intended for the slide-seal.

As shown in FIG. 6, the slide-seal 17 is longer than the slot 14 in middle piece 16 so it may be grasped and operated easily. Another reason for this is discussed below. Note that more than one slide-seal 17 could be used for better leak protection. The seal-insert pieces and the slide-seal may be constructed of plastic material, such as polycarbonate, or of steel material.

The seal-insert may be attached over the toner hopper openings by two-sided tape or glue or other suitable means. It may also be fused to the toner hopper by a dissolving chemical such as methylene chloride. Now, and this is an important part of this invention, the opening 2 of the toner hopper 1 shown in FIG. 1 is not of an even nature, but is uneven along its longitudinal dimension, and along its ends also, forming a series of hips and valleys along the length of the opening and at both ends. By attaching the seal-insert 10, by the above-mentioned methods, to the seal-attach-area perimeter of opening 2, the seal-insert 10 may be perfectly and permanently sealed in the toner hopper 1. The seal-insert may also be additionally sealed to the toner hopper by double-sided tape, silicone sealant materials, or other suitable adhesives to further protect against leakage caused by the unevenness of the opening 2. Another important part of this invention is that some toner hoppers 6, as shown in FIG. 2, have a constriction 8 at the entrance whereby the opening is narrower than the required width of a one-piece seal. This invention solves this problem by creating a permanent seal-insert 10 that stays affixed to the toner hopper 6 with its own slot 14 of a narrow enough width, that a narrow slide seal 17, can fit both in this slot 14 and through the said, constriction 8. The toner hopper 6 containing both the slide-seal 17 and seal-insert 10 will prevent toner spillage during cartridge shipment, or otherwise.

The seal-insert 10 with the slide-seal 17 thereby provides means for sealing the entire opening 9, and thereby prevent any dry toner from spilling from the toner hopper 6 during cartridge shipment, or, otherwise.

Accordingly, a very unique, convenient method and system is provided for re-filling, and re-sealing, the toner hopper for shipping, and re-using it, rather than having to purchase a new, expensive toner cartridge each time the toner hopper is empty.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalants to the claimed elements.

What is claimed is:

1. A sealing means for sealing a toner hopper used in printer or copying machine toner cartridges, in order that used toner cartridges can be refilled with toner, sealed, and transported with little possibility of spilling any of the toner from the toner hopper, said toner hopper having an opening through which toner flows, said sealing means comprising a seal-insert and slide-seal, wherein said seal-insert comprises separate pieces fastened into one component by a joining means such that there are outer pieces and a middle piece sandwiched between said outer pieces, said outer pieces having corresponding slots and said middle piece having a slot wider than said slots in said outer pieces and being open at one end, said slots in said outer and middle pieces being aligned such that a passage is formed through said seal-insert, said slide-seal comprising a strip of material that may be slid through the open end of said slot in said middle piece, blocking said passage in said seal-insert, so that when said seal-insert is attached to the toner hopper over said toner hopper opening, said slide-seal would provide a reusable seal blocking or allowing toner flow through said toner hopper opening and through said seal-insert passage.

2. The sealing means of claim 1 wherein said separate pieces of said seal-insert are made of plastic material.

3. The sealing means of claim 2 wherein said plastic material is polycarbonate.

4. The sealing means of claim 1 wherein said separate pieces of said seal-insert are made of steel material.

5. The sealing means of claim 1 wherein said joining means for fastening said separate pieces of said seal-insert into one component is a dissolving chemical used to fuse said pieces together.

6. The sealing means of claim 5 wherein said dissolving chemical is methylene chloride.

7. The sealing means of claim 1 wherein said joining means for fastening said separate pieces of said seal-insert into one component is two-sided tape.

8. The sealing means of claim 1 wherein the seal-insert is attached to the toner hopper by a dissolving chemical used to fuse them together.

9. The sealing means of claim 8 wherein said dissolving chemical is methylene chloride.

10. The sealing means of claim 1 wherein the seal-insert is attached to the toner hopper by two-sided tape.

11. The sealing means of claim 1 wherein the seal-insert is attached to the toner hopper by glue.

12. The sealing means of claim 1 wherein said slide-seal is made of steel material.

13. A sealing means as in claim 1 wherein said slide-seal is made of plastic material.

14. The sealing means of claim 1 wherein said plastic is polycarbonate material.

15. A sealing means as in claim 1 wherein there are two of said outer pieces of said seal-insert.

16. A sealing means as in claim 15 wherein said two outer pieces and said middle piece of said seal-insert are rectangular and said slots are longitudinally located on said pieces.

17. A sealing means as in claim 16 wherein said slots extend along the centerlines of said pieces.

18. A sealing means as in claim 1 wherein said toner hopper has a constriction at one end, said constriction being narrower than said opening in said toner hopper, and wherein said slide-seal and said slots in said seal-insert pieces are sized such that said slide-seal is narrow enough to slide through said constriction but wide enough to block said passage formed by said slots in said seal-insert pieces.

19. A sealing means as in claim 1 wherein said joining means for fastening said separate pieces of said seal-insert into one component is glue.

* * * * *